US005860041A

United States Patent [19]

Tanaka et al.

[11] Patent Number: 5,860,041

[45] Date of Patent: Jan. 12, 1999

[54] DEVICE FOR MEASURING TONER CONCENTRATION IN DEVELOPER COMPRISING TONER AND CARRIER

[75] Inventors: Masaki Tanaka; Kuniya Matsuura; Toshifumi Watanabe, all of Toyohashi, Japan

[73] Assignee: Minolta Co., Ltd., Osaka, Japan

[21] Appl. No.: 964,891

[22] Filed: Nov. 5, 1997

[30] Foreign Application Priority Data

Nov. 6, 1996 [JP] Japan ..... 8-293673

[51] Int. Cl.[6] ..... G03G 15/08

[52] U.S. Cl. ..... 399/65; 118/691

[58] Field of Search ..... 399/64, 65; 118/691; 356/445

[56] References Cited

U.S. PATENT DOCUMENTS 5,117,259 5/1992 Etou et al. .
5,383,007 1/1995 Kinoshita et al. .
5,398,106 3/1995 Eguchi .
5,530,530 6/1996 Tanaka et al. .

FOREIGN PATENT DOCUMENTS 63-52160 3/1988 Japan .

*Primary Examiner*—Joan Pendegrass
*Attorney, Agent, or Firm*—McDermott, Will & Emery

[57] ABSTRACT

A device for measuring toner concentration of developer housed in a developing system, which developer comprising toner and carrier. The device has a transparent detection window facing the interior of the developing system, which transparent detection window comprising a first transparent plate member and a second transparent plate member being in contact with the first transparent plate member. The first transparent plate member is made of a material which becomes charged, through its contact with the second transparent plate member, with the opposite polarity from the charge polarity of the toner and the second transparent plate member is made of a material which becomes charged, through its contact with the carrier, with the same polarity from the charge polarity of the toner, so that the second transparent plate member strongly repels the toner having the same polarity charge and adherence of the toner to the second transparent plate member is reliably prevented.

8 Claims, 5 Drawing Sheets

DEVICE FOR MEASURING TONER CONCENTRATION IN DEVELOPER COMPRISING TONER AND CARRIER

BACKGROUND OF THE INVENTION

1. Field of the Invention

The present invention pertains to a toner concentration measuring device that illuminates developer comprising toner and carrier and detects the toner concentration in the developer based on the reflected light from the developer.

2. Description of the Related Art

In a developing system that is used in an electrophotographic image forming apparatus and that uses two-component developer comprising toner and carrier, in order to ensure a certain image density, the percentage of the toner in the developer (hereinafter the 'toner concentration') must be measured and the toner must be added to the developer in accordance with the result of said measurement.

For this purpose, an optical toner concentration measuring device has been known that illuminates the developer inside the developing system via a transparent plate and detects the toner concentration based on the reflected light from the developer.

As an improved version of this optical toner concentration measuring device, a device has been proposed in which the transparent plate is made of a material that becomes charged, through its contact with the developer (the carrier contained in the developer, in particular), with the same polarity as the charge polarity of the toner, such that the toner will be electrically repelled and prevented from adhering to the transparent plate.

When the developer, particularly the carrier, is still new, the transparent plate becomes sufficiently charged through its contact with the carrier to prevent toner adherence. However, when the carrier becomes old, its charging capacity with respect to the toner and the transparent plate (its charge-providing capability) decreases, and it can no longer effectively prevent the toner from adhering to the transparent plate. Consequently, the problem arises that the toner concentration cannot be accurately measured, which leads to a loss of the control necessary to maintain appropriate image density.

SUMMARY OF THE INVENTION

The object of the present invention is to provide an improved toner concentration measuring device that resolves the problems described above.

Another object of the present invention is to provide a toner concentration measuring device that, when the carrier has deteriorated and its charge-providing capability has decreased, can effectively prevent the toner from adhering to the transparent plate.

BRIEF DESCRIPTION OF THE DRAWINGS

These and other objects and features of the present invention will become clear from the following description taken in conjunction with the preferred embodiment thereof with reference to the accompanying drawings, in which.

DETAILED DESCRIPTION OF THE PREFERRED EMBODIMENT

The preferred embodiment of the present invention is explained below with reference to the attached drawings.

(1) Construction of an image forming apparatus

Figure 1:
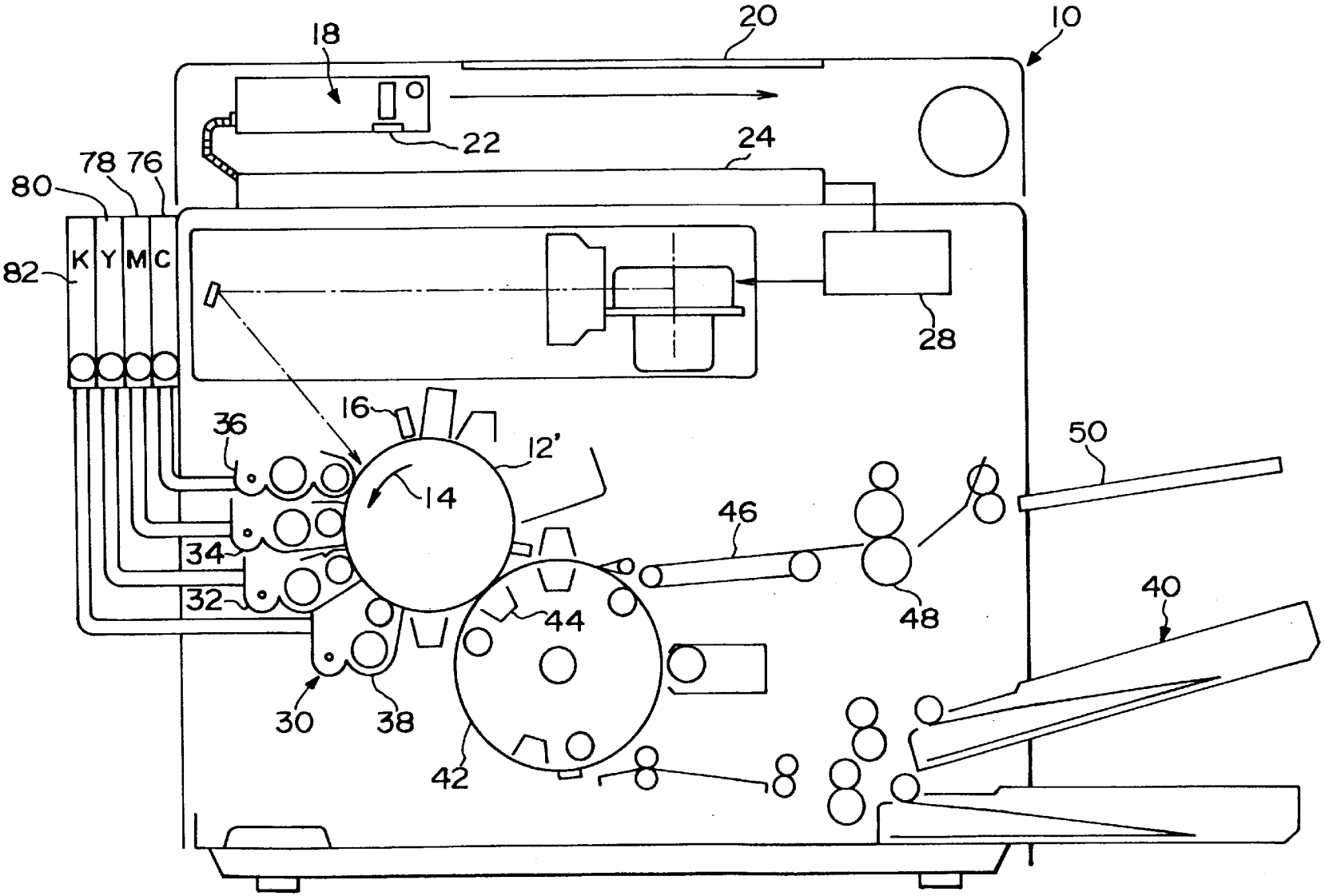
FIG. 1 is a cross-sectional view showing the entire construction of the copying machine of this embodiment.

FIG. 1 is a cross-sectional view showing the entire construction of an electrophotographic full-color copying machine 10.

In this copying machine 10, when a copy start button not shown in the drawing is pressed, drum-type photoreceptor 12, which is an electrostatic latent image carrier, rotates in the direction of an arrow 14 and its outer surface becomes charged to a certain potential by means of a charging unit 16. An image reader 18 illuminates an original (not shown in the drawing) that is placed on a platen glass 20. The light reflected off the original is received by an optical reading unit 22 where the reflected light is read as one of three color signals, i.e., red, blue or green, on a pixel-by-pixel basis. These color signals are converted into trinary signals, i.e., signals comprising yellow, magenta and cyan, or quaternary signals, i.e., signals comprising these three colors plus black, in an image processing circuit 24, and are then sent to a laser generator 28. The laser generator 28 exposes the charged area of the photoreceptor 12 with laser beams modulated based on said signals and forms an electrostatic latent image on the photoreceptor 12.

A developing system 30 has four developer units 32, 34, 36 and 38 that make said electrostatic latent image visible by using two-component developer comprising toner and carrier. These developer units contain yellow, magenta, cyan and black toner, respectively. These developer units can move toward the photoreceptor 12 such that a selected developer unit can approach the photoreceptor 12 and make the electrostatic latent image visible as a toner image of a prescribed color.

Copy sheets are housed in a paper feeder 40. The sheet that is fed from this paper feeder 40 is held around a transfer drum 42. The toner image on the photoreceptor 12 is then transferred to the sheet based on an electrical discharge from a transfer device 44. Where a full-color image is created, images created using yellow, magenta and cyan toner are sequentially transferred to the sheet one on top of the other. When the toner image transfers are completed, the sheet is separated from the transfer drum 42 and sent to a fusing device 48 by means of a conveyer 46, whereupon the toner image is fused onto the sheet and the sheet is ejected onto a paper eject tray 50.

(2) Construction of developer units

The construction of the developer units will now be explained in more detail with reference to FIGS. 2 and 3. While these drawings show only the construction of the developer unit 36 housing cyan toner, with the exception of the locations of some of the members, all of the developer units have a common basic construction.

A developing roller 54 facing the photoreceptor 12 is housed in a housing 52 of the developer unit 36, and a doctor blade 56 faces the outer surface of the developing roller 54 with a prescribed gap between them. A front conveyance path 58 and a rear conveyance path 60 are formed behind the developing roller 54. The front conveyance path 58 and rear conveyance path 60 are divided by a partition wall 62, and are linked only by means of channels 64 and 66 located on either side.

Developer conveyance members 68 and 70 are located in the conveyance paths 58 and 60, respectively. For the developer conveyance member 68 in the front conveyance path 58, either a bucket roller, a screw having a spiral shaped blade member located around its rotational axis, or a conveyance blade having oblong blade members located around the rotational axis at prescribed intervals may be effectively used. For the developer conveyance member 70 in the rear conveyance path 60, either the screw or the conveyance blade described above may be effectively used.

A toner refill path 72 is formed at the rear part of the rear conveyance path 60. This toner refill path 72 is connected to the rear conveyance path 60 by means of a connecting opening 74. The toner refill paths 72 for each of the developer units 32, 34, 36 and 38 are connected to toner refill devices 76, 78, 80 and 82, respectively (see FIG. 1), each of which contains refill toner of the same color as that used in the corresponding developer unit, and the toner supplied from the toner refill device is dropped into the rear conveyance path 60 by means of a rotating member 84 mounted to the toner refill path 72, thereby supplying the refill toner.

Figure 2:
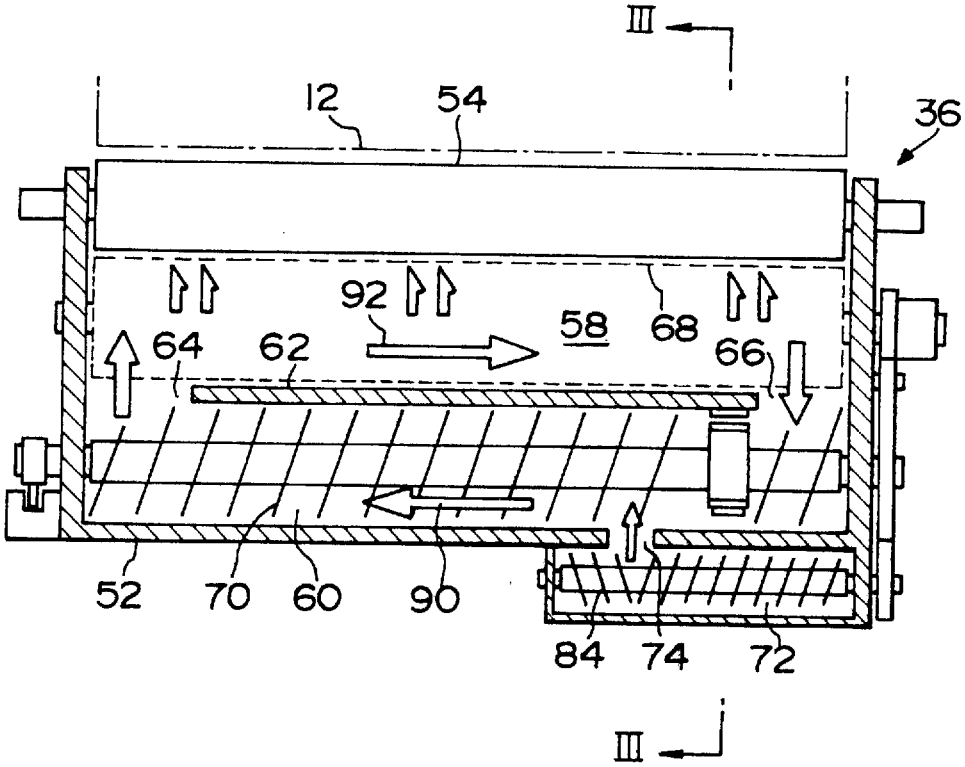
FIG. 2 is a transverse cross-sectional view of the developing system in the copying machine of this embodiment.
Figure 3:
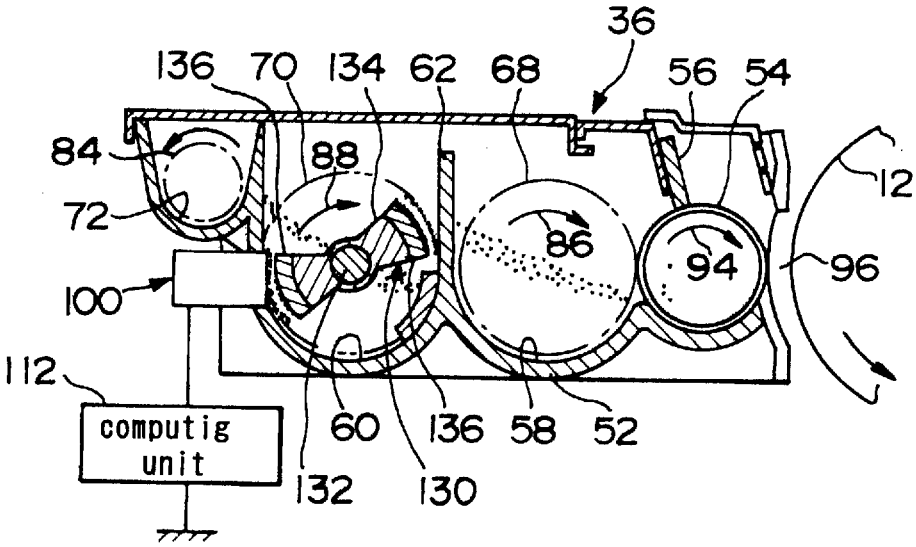
FIG. 3 is a cross-sectional view of the developing system shown in FIG. 2, cut along the III—III line.
Figure 4:
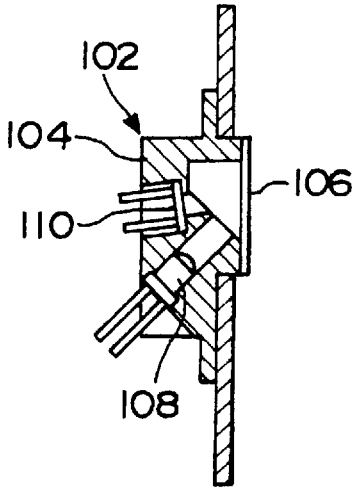
FIG. 4 is a cross-sectional view of a reflecting concentration indicator.

As shown in detail in FIGS. 2 and 3, in the developer unit 36 having the construction described above, the developer conveyance members 68 and 70 rotate in the directions indicated by arrows 86 and 88, respectively. Consequently, the developer in the rear conveyance path 60 is conveyed to the front conveyance path 58 via a channel 64 after being conveyed in the direction of an arrow 90, while the developer in the front conveyance path 58 is conveyed to the rear conveyance path 60 via a channel 66 after being conveyed in the direction indicated by an arrow 92. In this way, the toner and carrier contained in the developer circulate through the front and rear conveyance paths 58 and 60 while being mixed and churned by the developer conveyance members 68 and 70. In doing so, they come into frictional contact with each other and become charged with prescribed polarities. In this embodiment, the carrier becomes charged with a positive polarity and the toner becomes charged with a negative polarity.

Some of the developer conveyed in the front conveyance path 58 is supplied to the developing roller 54. The developer supplied to the developing roller 54 is held onto its outer surface by means of the magnetic force of a magnet incorporated in the developing roller 54, and is conveyed in the direction of an arrow 94 via the rotation of this developing roller 54. After the amount conveyed is adjusted by means of the doctor blade 56, this developer then comes into contact with the photoreceptor 12 in the area where the photoreceptor 12 and the developing roller 54 face each other (a developing area 96), whereupon the electrostatic latent image is made visible by the toner. The developer that has passed the developing area 96 returns to the front conveyance path 58 as the developing roller 54 rotates.

(3) Toner concentration measuring device

A toner concentration measuring device in which the present invention is applied will now be explained with reference to FIGS. 2 through 5. The toner concentration measuring device 100 is equipped with a reflecting concentration indicator 102 having the construction shown in FIG. 4. This reflecting concentration indicator 102 includes a container shaped frame 104, the opening of which is covered by a transparent plate (transparent detection window) 106. A light-emitting element 108 and a light-receiving element 110 are mounted to the frame 104. Infrared light is emitted from the light-emitting element 108 through the transparent plate 106, and the reflected light can be detected by the light-receiving element 110 via the transparent plate 106 (see FIG. 4).

This reflecting concentration indicator 102 is fixed to the rear wall of the rear conveyance path 60 so that the transparent plate 106 faces the developer conveyance member 70, and the light-receiving element 110 is electrically connected to a concentration computing unit 112 (see FIG. 3).

Figure 5:
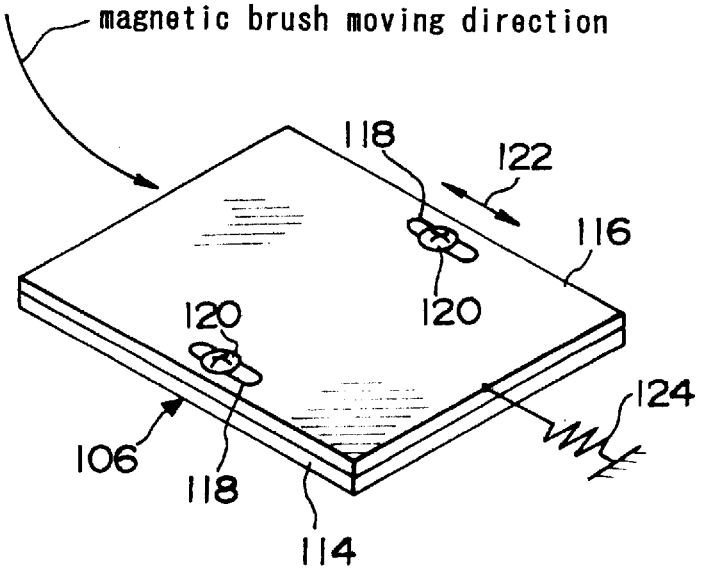
FIG. 5 is a perspective view of a transparent plate.

As shown in FIG. 5 in detail, the transparent plate 106 comprises a first transparent plate member 114 fixed to the frame 104 and a second transparent plate member 116 stacked on top of it. The first transparent plate member 114 faces the interior of the reflecting concentration indicator 102, while the second transparent plate member 116 faces the interior of the developer unit (the rear conveyance path 60). Long grooves 118 and 118 aligned in the direction of the rotation of the developer conveyance member 70 are formed in the second transparent plate member 116. The second transparent plate member 116 can move back and forth in sliding contact with the first transparent plate member 114 in the direction of rotation of said developer conveyance member 70 as well as in the opposite direction (in the directions of an arrow 122 in FIG. 5) by means of guide screws 120 and 120 mounted in the long grooves 118 and 118. The second transparent plate member 116 also receives force in the direction opposite from the direction of the rotation of the developer conveyance member 70 by means of an elastic member 124 comprising a spring, rubber, etc.

For the material from which the first transparent plate member 114 is constructed, a material is chosen that becomes charged with the opposite polarity from the toner's charge polarity (in this embodiment, positive polarity) by means of its contact with the second transparent plate member 116. On the other hand, for the material from which the second transparent plate member 116 is constructed, a material is chosen that becomes charged with the same polarity as the toner's charge polarity (in this embodiment, negative polarity) by means of its contact with the developer (particularly the carrier) or with the first transparent plate member 114.

Figure 6:
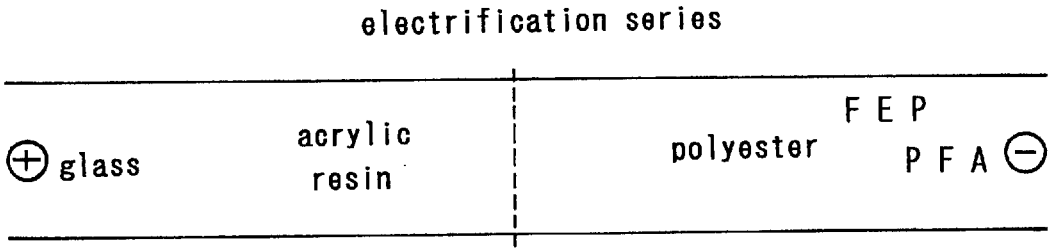
FIG. 6 is a drawing showing the electrification rankings of the materials used for the transparent plate members and the toner.

Specifically, where the toner is charged with a negative polarity and the carrier is charged with a positive polarity, and where a toner comprising mainly polyester resin is used, as in this embodiment, it is preferred, as shown in the electrification series chart of FIG. 6, to use a plate made of acrylic resin or glass having a more positive polarity ranking than polyester resin for the first transparent plate member 114, and to use a plate or film made of Teflon varieties PFA (perfluoroalkoxyl) or FEP (fluorinated ethylene-propylene), etc., having a more negative polarity ranking than polyester resin for the second transparent plate member 116.

The toner concentration measuring device 100 is also equipped with a cleaning member 130 that cleans the surface of the transparent plate 106 (the second transparent plate member 116) (see FIG. 3). This cleaning member 130 comprises a support member 134 that is fixed to and supported around a shaft 132 of the conveyance member 70 and a magnet 136 that is attached to this support member 134, and faces the reflecting concentration indicator 102. The surface of the transparent plate 106 is cleaned in a cyclic fashion as the conveyance member 70 rotates, by means of a magnetic developer brush that is adsorbed onto the surface of the magnet 136. The shaft 132 of the conveyance member 70 is grounded.

Figure 7:
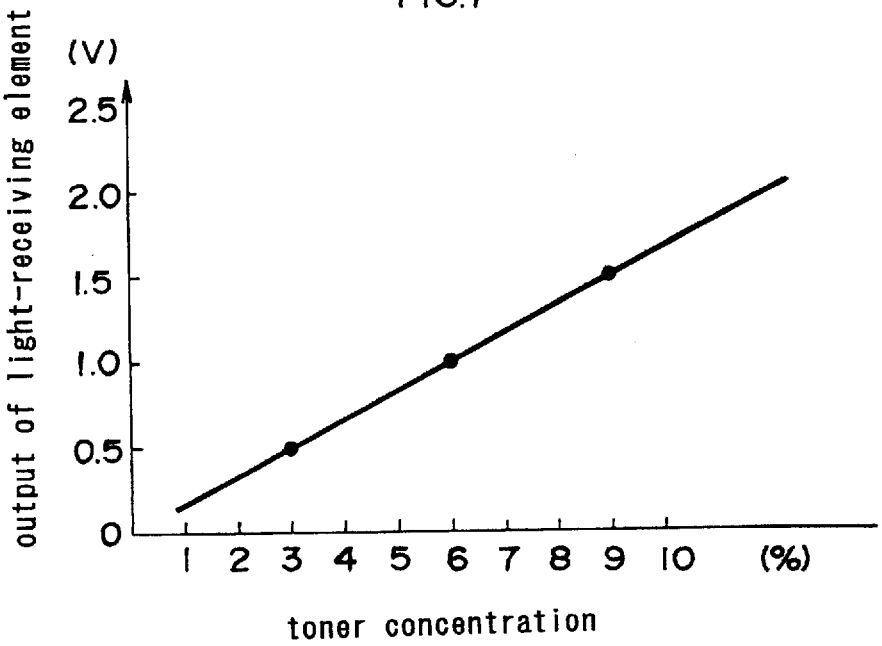
FIG. 7 is a drawing showing the relationship between the toner concentration and the output from the light-receiving element.

The toner concentration measuring device 100 having the construction described above illuminates, using infrared light emitted from the light emitting element 108, the developer that passes over the surface of the transparent plate 106 while moving in the rear conveyance path 60 in the direction of the arrow 90 by means of the conveyance member 70. When this occurs, the carrier absorbs the infrared light and the toner reflects the infrared light. The reflected infrared light is detected by the light-receiving element 110. The output from the light-receiving element 110 has a certain relationship to the toner concentration (see FIG. 7). Specifically, the light-receiving element 110 outputs signals of increasingly higher voltage as the toner concentration increases. The computing unit 112 calculates the toner concentration based on the output from the light-receiving element 110. If the toner concentration thus detected falls below a prescribed value, the computing unit 112 drives the rotating member 84 and provides the refill toner to the developer unit from the corresponding toner refill device.

This computing unit 112 is connected to a controller of the developer unit or to that of the copying machine. Alternatively, these controllers themselves may function as the computing unit 112.

Figure 8:
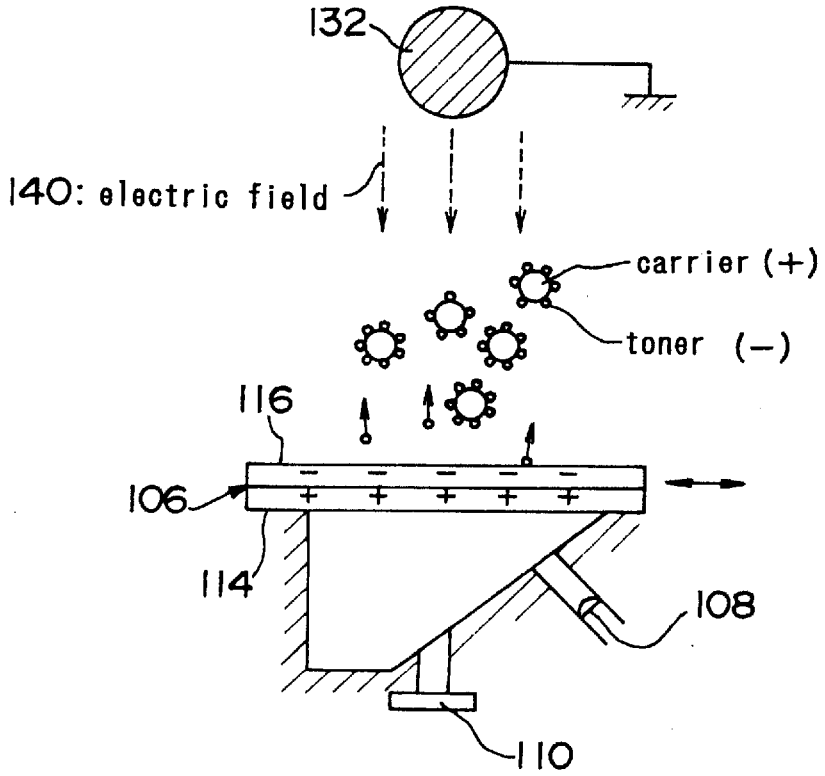
FIG. 8 is a drawing to explain the toner adherence prevention function performed by the transparent plate of this embodiment.

The toner adherence prevention effect of the transparent plate 106 will now be explained. As described above, the transparent plate 106 comprises the movable second transparent plate member 116 that becomes charged with the same polarity as the charge polarity of the toner (negative polarity) by means of its contact with the developer (the carrier), and the stationary first transparent plate member 114 that becomes charged with the opposite polarity from the charge polarity of the toner (positive polarity) by means of its contact with the second transparent plate member 116. Therefore, when the magnetic brush that is adsorbed onto the magnet 136 of the cleaning member 130 comes into contact with the second transparent plate member 116 periodically, the second transparent plate member 116 becomes charged with the same polarity as the charge polarity of the toner (negative polarity). Moreover, as shown in FIG. 5, the second transparent plate member 116 that receives force in the direction opposite from the direction of movement of the magnetic brush vibrates or moves in a direction parallel to this direction when it comes into contact with the magnetic brush, and comes into frictional contact with the first transparent plate member 114. Thereby, the first transparent plate member 114 then becomes charged with the opposite polarity of the charge polarity of the toner (positive polarity), and the second transparent plate member 116 conversely becomes charged with the same polarity as the charge polarity of the toner (negative polarity), as shown in FIG. 8. In other words, as a result of coming into contact with the developer and with the first transparent plate member 114, the second transparent plate member 116 becomes charged with a higher potential than it would be simply from coming into contact with the developer. Consequently, the second transparent plate member 116 strongly repels the toner having the same polarity charge, and therefore adherence of the toner to the second transparent plate member 116 is reliably prevented. Moreover, the shaft 132 of the conveyance member 70 facing the transparent plate 106 is grounded, and an electric field 140 is formed between the shaft 132 and the second transparent plate member 116, as shown in FIG. 8. Consequently, the toner charged with a negative polarity is attracted in the direction away from the transparent plate 106, and adherence of the toner to the transparent plate 106 is further prevented.

The change in the output of the light-receiving element 110 was investigated in the situation where the transparent plate 106 comprised only a single layer (as in the conventional example), and in the situation where it comprised the first transparent plate member 114 and the second transparent plate member 116 in accordance with the present invention. First, where the transparent plate 106 comprised a single plate made of PFA or FEP, the potential of the charge of such transparent plates was −380V to −400V and −320V to −350V, respectively, and contamination of the transparent plate surface (toner adherence) occurred even with new developer freshly placed in the developer unit, and the output from the light receiving element decreased as time passed.

On the other hand, where the first transparent plate member 114 was made of glass and the second transparent plate member 116 was made of PFA film, the surface of the second transparent plate member 116 became charged to a potential of −550V to −580V, and the output from the light-receiving element was stable not only with new developer, but also with developer that had been churned inside the developer unit for some time, confirming that the toner concentration could be accurately measured. Where the first transparent plate member 114 was made of acrylic resin and the second transparent plate member 116 was made of PFA film, the surface potential of the PFA film was −480V to −510V. Where the first transparent plate member 114 was made of glass and the second transparent plate member 116 was made of FEP film, the surface potential of the FEP film was −450V to −470V. From these experiments, the desirability of using materials having electrification rankings as far apart as possible for the first transparent plate member 114 and the second transparent plate member 116 can be seen.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

For example, in the embodiment described above, the magnet 136 was located on the part of shaft 132 of the conveyance member 70 facing the transparent plate 106, and the surface of the transparent plate 106 was cleaned by the magnetic brush held on the surface of magnet 136, but this type of cleaning member is not necessarily essential. Where a cleaning member is not used, it is acceptable if the second transparent plate member 116 is mounted such that it can vibrate or move in a direction parallel to the movement of the developer along the developer conveyance path 60 (the direction shown by the arrow 90 in FIG. 2), and is made to vibrate or move in said direction by means of its contact with the developer conveyed by the conveyance member 70.

Figure 9:
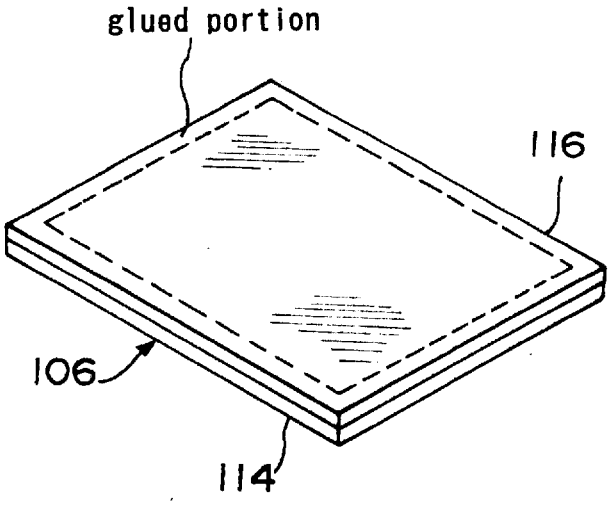
FIG. 9 is perspective view showing another construction of the transparent plate.

Further, it is not necessarily essential for the first transparent plate member 114 and the second transparent plate member 116 to be vibrated or moved in directions parallel to their surfaces. They may be vibrated or moved in directions perpendicular to their surfaces. Specifically, the same effect as the construction shown in FIG. 5 can be obtained even where the contact surfaces of the first transparent plate member 114 and the second transparent plate member 116 are glued together via their entire outer edges using an adhesive substance while the central contact areas are separated, as shown in FIG. 9.

It is also desirable for the surface of the second transparent plate member 116 that comes into contact with the developer to be roughened beforehand so that, even if the surface of the second transparent plate member 116 is damaged by being in contact with the developer, causing the reflected light to become scattered, the toner concentration measurement result will not be affected.

In addition, in the embodiment described above, the transparent plate 106 comprised the two transparent plate members 114 and 116, but it is acceptable if it comprises three or more transparent plate members.

What is claimed is:

1. A toner concentration measuring device used in a developing system that houses developer comprising toner and carrier, said toner concentration measuring device comprising:

a transparent detection window which faces the interior of the developing system;

a light-emitting unit which illuminates the developer inside the developing system through the transparent detection window;

a light-receiving unit which receives the light emitted from the light-emitting unit and reflected off the developer through the transparent detection window and which outputs a signal corresponding to the amount of the light thus received; and a computing unit which computes the toner concentration of the developer based on the signal output by the light-receiving unit, wherein said transparent detection window comprises a first transparent plate member located on the side of the light-emitting unit and light-receiving unit and a second transparent plate member located on the side of the developer and movably attached to the first transparent plate member, and wherein said first transparent plate member is made of a material which becomes charged, through its contact with the second transparent plate member, with the opposite polarity from the charge polarity of the toner, and said second transparent plate member is made of a material which becomes charged, through its contact with the carrier, with the same polarity as the charge polarity of the toner.

2. The toner concentration measuring device as claimed in claim 1, wherein said second transparent plate member is attached to the first transparent plate member such that it can move in directions parallel to the contact surfaces of the first and second transparent plate members.

3. The toner concentration measuring device as claimed in claim 2, wherein said second transparent plate member is attached to the first transparent plate member such that it can move in the directions parallel to the direction of movement of the developer inside the developing system.

4. The toner concentration measuring device as claimed in claim 2, wherein said developing system has a rotating member which churns and conveys the developer and said second transparent plate member is attached to the first transparent plate member such that it can move in the directions parallel to the direction of rotation of the rotating member.

5. The toner concentration measuring device as claimed in claim 1, wherein said second transparent plate member is attached to the first transparent plate member by gluing its entire outer edge to the outer edge of the first transparent plate member.

6. A toner concentration measuring device for measuring toner concentration of developer that comprises toner and carrier, said toner concentration measuring device comprising:

a transparent detection window which comprises a first transparent plate member and a second transparent plate member being in moveable contact with the first transparent plate member;

a light-emitting unit which illuminates the developer through the transparent detection window;

a light-receiving unit which receives the light emitted from the light-emitting unit and reflected off the developer through the transparent detection window and which outputs a signal corresponding to the amount of the light thus received; and a computing unit which computes the toner concentration of the developer based on the signal output by the light-receiving unit, wherein said first transparent plate member is made of a material which becomes charged with the opposite polarity of the charge polarity of the toner, and said second transparent plate member is made of a material which becomes charged with the same polarity as the charge polarity of the toner.

7. The toner concentration measuring device as claimed in claim 6, wherein said toner becomes charged with a negative polarity, said first transparent plate member is made of a material which has a more positive electrification ranking than the toner and said second transparent plate member is made of a material which has a more negative electrification ranking than the toner.

8. The toner concentration measuring device as claimed in claim 7, wherein said toner mainly comprises polyester resin, said first transparent plate member is made of acrylic resin or glass and said second transparent plate member is made of PFA (perfluoroalkoxyl) or FEP (fluorinated ethylene-propylene).

* * * * *